United States Patent [19]

Shannon et al.

[11] Patent Number: 5,000,357

[45] Date of Patent: Mar. 19, 1991

[54] SOFT DRINK DISPENSER

[75] Inventors: Joseph W. Shannon; Thomas S. Green, both of Kent; Jeffery C. Rice, Hudson, all of Ohio

[73] Assignee: ABC/Sebrn Tech Corp. Inc., Akron, Ohio

[21] Appl. No.: 405,448

[22] Filed: Sep. 11, 1989

Related U.S. Application Data

[62] Division of Ser. No. 107,403, Oct. 13, 1987, Pat. No. 4,903,862.

[51] Int. Cl.[5] ..... B67D 5/56

[52] U.S. Cl. ..... 222/129.1; 222/330; 222/571; 239/406

[58] Field of Search ..... 222/129.1–129.4, 222/54, 65, 641, 640, 330, 571; 239/406, 400, 405, 403, 446, 448, 449, 600, 589

[56] References Cited

U.S. PATENT DOCUMENTS

| | | | |
|---|---|---|---|
| 3,991,911 | 11/1976 | Shannon et al. | 222/129 H X |
| 4,076,145 | 2/1978 | Zygiel | 222/129.2 X |
| 4,211,342 | 7/1980 | Jamgochian | 222/129.4 |
| 4,392,588 | 7/1983 | Scalera | 222/129.4 |
| 4,444,336 | 4/1984 | Nielsen | 222/129.4 |
| 4,487,333 | 12/1984 | Pounder et al. | 222/54 |
| 4,753,370 | 6/1988 | Rudick | 239/406 |
| 4,903,862 | 2/1990 | Shannon et al. | 222/129.4 X |

FOREIGN PATENT DOCUMENTS 250003 12/1987 European Pat. Off. ..... 222/129.1

*Primary Examiner*—Andres Kashnikow
*Assistant Examiner*—Gregory L. Huson
*Attorney, Agent, or Firm*—Renner, Kenner, Grieve, Bobak, Taylor & Weber

[57] ABSTRACT

A soft drink dispenser capable of rapidly dispensing carbonated beverages with minimized foaming action. The syrup and soda are dispensed separate from each other and allowed to mix upon the ice in a cup placed beneath the dispensing head. The dispensing of the syrup and soda is staged to minimize foaming while achieving optimum beverage taste. Syrup is dispensed from individual pumps which communicate with a bulk supply. The syrup is consolidated in the pumps, preventing waste or the introduction of "slugs" into the dispensing line. The temperature of the syrup is monitored and compensation is made during the dispensing cycle to accommodate changes in viscosity. In generating soda, water is precooled and then introduced into an insulated tank where it is subjected to pressurized carbon dioxide. In the pour head, a cluster of soda orifices are peripherally encompassed by syrup orifices, certain of which are angled to cause the syrup to convolute the stream of soda. The syrup is spaced from the soda and maintains a spaced relationship until entry into the cup or glass.

19 Claims, 9 Drawing Sheets

SOFT DRINK DISPENSER

This is a division of application Ser. No. 107,403 filed Oct. 13, 1987, now U.S. Pat. No. 4,903,862.

TECHNICAL FIELD

The invention herein resides in the art of beverage dispensers and, more particularly, to a soft drink beverage dispenser wherein a syrup is mixed with carbonated water, soda, or the like.

BACKGROUND ART

Heretofore, numerous types of soft drink dispensers have been known. In such dispensers, a flavored syrup is mixed with another liquid such as water, carbonated water or soda to achieve the composite drink. Prior soft drink dispensers of this nature have been typically slow in operation due to the foaming action which resulted when the syrup and soda are mixed, particularly at fast flow rates. The prior art teaches that the syrup and soda be mixed in a dispensing head by means of a mechanical diffuser. The joining of the syrup with the soda within the dispensing head causes foam to be generated in the head itself such that foam, rather than liquid, is dispensed. As a result, dispensing the drink must be done in steps with intermittent pauses introduced by the operator to allow the foam to settle. Such pauses delay the dispensing operation and, in a fast service environment, become extremely costly. The problem of foaming has further been found to arise from the fact that the syrup and soda are continuously poured together rather than staged or phased with respect to each other. Finally, foaming has been found to be a problem in virtually all dispensed carbonated beverages, not only slowing the dispensing cycle, but resulting in a "flat" drink due to the attendant reduction in carbonation level.

The prior art soft drink dispensers have also demonstrated an inconsistency in drink formulation as a function of temperature. It is known that sugar-based soft drink syrups are temperature sensitive and, for a given pressure head, the rate of syrup flow varies as a function of the temperature of the syrup. More particularly, the relationship between syrup flow rate and temperature is of a general exponential nature. The rate of syrup flow also varies from syrup to syrup as a function of the syrup composition. The prior art has taught a relational flow of syrup and soda to achieve the desired consistency, but has provided no means for compensating for such relation as a function of syrup temperature or composition. Indeed, the prior art has taught the use of mechanically regulated flow controls including metering screws for achieving the desired adjustment of syrup dispensing rates, but such controls must be manually adjusted and are generally ineffective in compensating for temperature and pressure variations in the relationship between the components of the beverage. Further, such mechanical controls have typically been a source of operational problems in that they are prone to clog due to the increased viscosity at lower temperatures and to the crystalline nature of the syrup.

The prior art has suggested monitoring syrup temperature at the dispensing head, but not at various points in the dispensing system. However, it is known that the syrup temperature may vary from point to point throughout the system. If syrup temperature in any portion of the apparatus changes but a few degrees, the resultant viscosity change will tend to vary the syrup flow at the dispensing station. Accordingly, monitoring syrup temperature at various points within the system is necessary to institute appropriate compensation to achieve the desired flow rates for beverage consistency.

It has further been known that prior art soft drink dispensers have generally been inflexible with respect to dispensing low carbonation drinks or those having a soda component different from the usual 5 parts of water or carbonated water to 1 part of syrup. While it has been known to add a pure water source to the dispensing cycle of low carbonation drinks to lower the effective carbonation level, the degree of carbonation variability has been extremely limited. No known system has provided for a virtually infinite degree of variability of the carbonation level by varying the flow of water and/or carbonated water to the soft drink.

The prior art has failed to recognize the benfits of rechambering the syrup for soft drinks in a separate pump or chamber from which it may be dispensed for combination with other components for the formulation of the soft drink. Instead, prior systems have typically dispensed the syrup from the bulk tank or canister in which it is received to the dispensing station. Such prior dispensing systems have accordingly been Plagued with problems of line pressure variation, viscosity changes, considerations to be given line length and diameter, and the like. In like manner, these prior systems have required high pressures of $CO_2$ gas at the source or canister to pump the syrup to the dispensing head, such pressures often resulting in carbonation of the syrup itself. The resultant volatile nature of the syrup made it difficult to dispense.

In the prior systems, when the canister emptied of syrup the dispensing line from the canister to the dispensing head would fill with gas pockets or slugs such that the entire length of the line would be a combination of gas and syrup. After the empty canister was replaced, the drinks dispensed until the line became completely filled with syrup would be quite weak and the dispensing would be sporadic due to gas slugs in the line. The prior art remedied this problem by purging the line through the dispensing head after replacement of the canister, but only at the expense of wasted time, syrup, and $CO_2$ gas.

The prior art failed to recognize the benefits which could be obtained by consolidating the syrup from various canisters for dispensing from a single pump, eliminating the aforesaid problems and allowing the system to operate from any backroom container or pumping source, whether it be pressure, mechanical, gravity, or other nature. It similarly failed to recognize the benefits of venting a rechambered pump to prevent carbonation of the syrup.

Previous attempts to remedy certain of the foregoing problems have included the so-called "bag-in-the-box" approach, but with limited success. Such systems remain incapable of properly compensating for line temperature/pressure changes which occur between the pump and dispensing head. Additionally, high $CO_2$ pressures were found necessary to drive the pumps for such systems with the inherent short coming of excessive cost to maintain such pressures.

Known soft drink systems generally require on-site adjustment of brix level, tailored to the line lengths, backroom pressure settings, ambient temperature and the like at the system location. These prior systems simply are not conducive to factory adjustment of brix because the dispensing characteristics of such systems are site dependent.

Typical soft drink dispensers have a separate dispensing head or faucet to dispense each brand or type of soft drink, complicating the structure and operation of the system. Those systems which have sought to use a single dispensing head for all types of soft drinks have generally experienced a cross mix of brands resulting from residue remaining in the head after a dispensing cycle.

It has further been known that exposure of soft drink syrup to the air tends to contaminate or rapidly age the syrup, significantly reducing beverage quality. Further, failure of the prior art to monitor the system for the detection of malfunctions and timely termination of the operation thereof has often resulted in a reduction in drink quality and concomitant rise in cost of operation.

The prior art has further been devoid of means for efficiently cooling the soda at start-up, requiring either a significant delay between energization of the system and the dispensing of beverages or a degradation in the quality of beverages initially dispensed. Yet further, the prior art has been devoid of a soft drink dispenser capable of floating syrup at the end of a dispensing cycle without resulting in a residue of such syrup being dispensed into the next soft drink or without changing the brix or sweetness level of the beverage.

DISCLOSURE OF THE INVENTION

In light of the foregoing, it is a first aspect of the invention to provide a soft drink dispenser which eliminates the mechanical diffuser of the prior art, significantly reduces foaming, and allows for rapid dispensing of carbonated soft drinks of various brix values.

Another aspect of the invention is the provision of a soft drink dispenser wherein the dispensing of syrup is compensated as to both the temperature and nature of the syrup to achieve drink consistency over a wide range of operational temperatures.

Yet another aspect of the invention is to provide a soft drink dispenser which is readily capable of dispensing soft drinks having a broad range of carbonation levels.

Still a further aspect of the invention is the provision of a soft drink dispenser wherein the syrup is sealed from the ambient and air is prevented from making contact with the syrup.

Still a further aspect of the invention is the provision of a soft drink dispenser wherein the syrup pumps are monitored and the operation thereof terminated in the event of sensing a malfunction or empty condition.

Yet an additional aspect of the invention is the provision of a soft drink dispenser wherein the soda is efficiently and effectively cooled at start-up.

Still a further aspect of the invention is the provision of a soft drink dispenser in which syrup may be floated on the top of a drink at the end of a dispensing cycle without a resultant residue dispensed in a subsequent drink and without changing the brix of the beverage.

The foregoing and other aspects of the invention which will become apparent as the detailed description proceeds are achieved by a beverage dispenser, comprising: a pour head; first means for dispensing a soda through said pour head; second means for dispensing a flavoring syrup through said pour head; and control means interconnected between said first and second means for regulating timed periods of dispensing said soda and flavoring syrup through said pour head during a dispensing cycle to obtain a desired drink.

Other aspects of the invention are achieved by a syrup dispensing system for a soft drink dispenser, comprising: a pour head; a bulk supply of syrup; first means interconnected between said pour head and said bulk supply for receiving syrup from said bulk supply and dispensing said syrup through said pour head; and control means connected to said first means for controlling said receipt of syrup by said first means from said bulk supply and said dispensing of syrup through said pour head.

Yet further aspects of the invention are satisfied by a beverage dispenser, comprising: a pour head; first means for generating soda and dispensing soda through said pour head; control means connected to said first means for controlling said generating of soda and dispensing of said soda through said pour head.

Still additional aspects of the invention are attained by a beverage dispenser for dispensing beverage into a receiving container, comprising: a source of syrup; a source of soda; and a pour head in communication with said syrup and soda sources, adapted for dispensing syrup and soda in spaced-apart streams, precluding appreciable mixing of said syrup and soda until received by said container.

DESCRIPTION OF DRAWINGS

For a complete understanding of the objects, techniques and structure of the invention reference should be had to the following detailed description and accompanying drawings wherein.

BEST MODE FOR CARRYING OUT THE INVENTION

Figure 1:
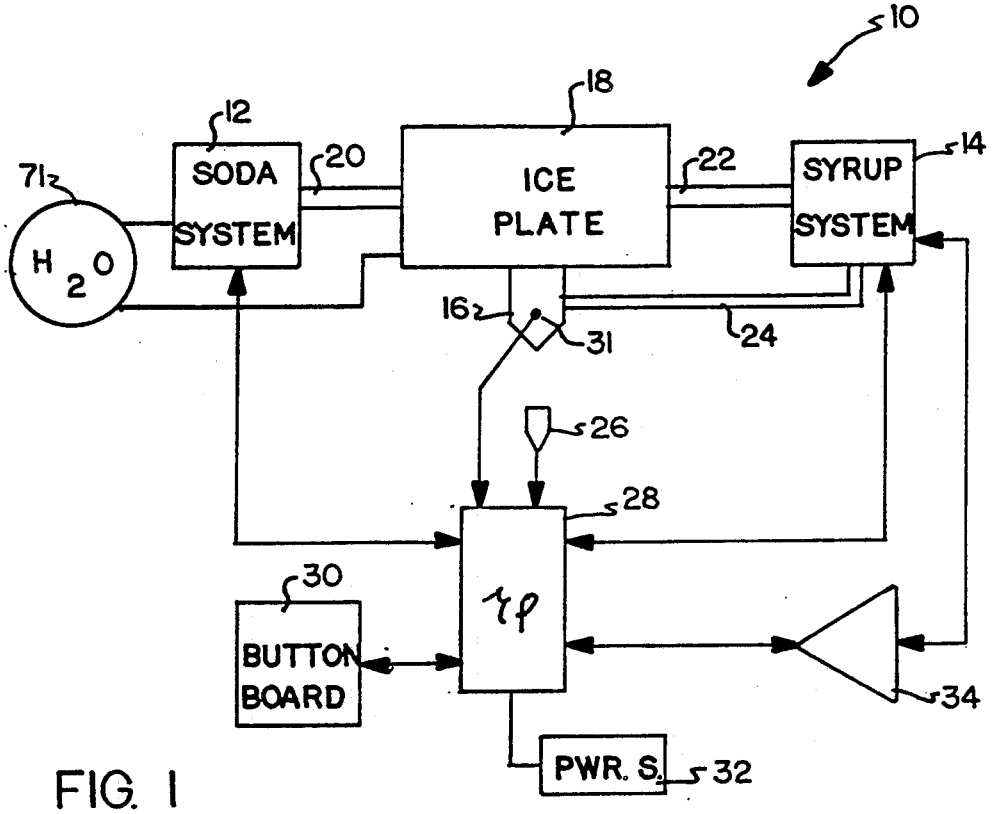
FIG. 1 is a block diagram of the soft drink dispenser of the invention.

Referring now to the drawings and more particularly FIG. 1, it can be seen that a soft drink dispenser according to the invention is designated generally by the numeral 10. The dispenser 10 includes a soda system 12 which would typically include a pressurized source of soda or carbonated water as the main bulk ingredient of the soft drinks to be dispensed. Flavoring for the soft drinks is provided through the syrup system 14 which provides the basic flavoring syrup for the various soft drinks. The syrup and soda are dispensed through a pour head 16 in the manner to be discussed hereinafter to be combined upon the ice within a cup or glass to achieve the desired end product.

An ice plate 18 having a plurality of serpentine passages therein is provided between the soda system 12 and pour head 16 for purposes of cooling the soda prior to dispensing. As shown, the soda passes through the conduit 20 from the system 12 to the ice plate 18. Diet syrups are also cooled through the ice plate 18 and are passed thereto through the conduit 22. Syrups for diet drinks typically have no sugar content and have a zero or extremely low brix value associated therewith. Accordingly, such syrups may be cooled without appreciable change to their viscosity. In contradistinction, syrups of high sugar content or of a high brix value are passed through the conduit 24 directly from the syrup system 14 to the pour head 16, without passing through the ice plate 18. Such high brix syrups are typically significantly thickened by reduced temperatures, having a viscosity inversely proportional to temperature.

A water source 71 is provided to supply water to the soda system 12, as will be discussed with respect to FIG. 3, and to the ice plate 18 where it is cooled for dispensing with beverages which require plain water as an ingredient. The use of plain water to reduce carbonation, or as an ingredient for ice tea or the like will be discussed later herein.

A pour switch 26 is provided in juxtaposition to the pour head 16 and is actuated by the placement of a cup or glass thereunder. Upon actuation, the pour switch 26 advises the microprocessor 28 that a cup is in position for dispensing of a combination of soda and syrup from the systems 12,14. The particular ingredients and volumes dispensed are controlled by the microprocessor 28 through a button board 30, such board allowing an operator to select both the type and size of soft drink to be dispensed. Of course, a power supply 32 is provided in standard fashion.

An important feature of the instant invention is the provision of a temperature compensated pressure source 34. As shown, the pressure source intercommunicates between the microprocessor 28 and syrup system 14 to provide the appropriate drive for the syrup to obtain a consistency of drink irrespective of syrup temperature. As discussed above, with high brix syrups having a viscosity which is inversely proportional to temperature, such compensation must be made to assure drink consistency. In order to guarantee the dispensing of an appropriate amount of syrup at all temperatures, the instant invention monitors the syrup temperature at the syrup pump and then takes appropriate compensating action to modify the head pressure on the syrup to maintain the desired dispensing volume. Such a structure will become more fully apparent with respect to FIG. 2, but it should be understood at this time that each of the syrup pumps includes a thermistor or other temperature sensing device which sends a temperature signal to the microprocessor 28. For each syrup, the microprocessor 28 has stored the data curve showing the relationship between temperature and pressure to allow for an appropriate modification of the pressure to achieve the desired amount of dispensed syrup. This, of course, presupposes that the time for dispensing syrup remains the same. In any event, and as will be further apparent from FIG. 2, a voltage to pressure or current to pressure transducer is then used to appropriately modify the dispensing pressure in the syrup pump to commensate for the syrup temperature as determined by the microprocessor 28 from a temperature curve or look-up table particularly associated with that syrup. It should, of course, be understood that such temperature compensation is typically only needed for sugar-containing syrups, and not for diet syrups or those having a low or zero brix value.

It is also contemplated that temperature compensation may be made by regulating the amount of time for which syrup is dispensed, such time being made a function of temperature. In this event, the temperature of the syrup is sensed by the thermistor supplied to the microprocessor 28 which then opens and closes the dispensing valve for the syrup at such frequency and for such time durations as are necessary to achieve the desired amount of syrup. In other words, the duty cycle for the dispensing valve is regulated as a function of temperature. Obviously, the valve would be set so that it would be open for a full time period when the syrup is cold and then pulsed on and off at increased frequency as the syrup warmed up. The duty cycle would be determined from the look-up table or temperature curve stored in the microprocessor 28 and associated with the specific syrup.

While the processor 28 has access to the temperature of syrup in the pumps, there will also be a temperature change of the syrup in the conduit 24 from the syrup system 14 through the pour head 16. As a function of time between dispensing cycles, the syrups in the conduit 24 will approach the ambient temperature surrounding the conduit 24 and within the pour head 16. For each syrup, the processor 28 has a stored table respecting changes in viscosity as a function of ambient temperature and the period of time that the particular syrup has remained in the conduit since the prior dispensing cycle. The processor 28 accordingly adjusts the syrup flow, either by time or pressure compensation during the dispensing cycle. The tables take into account the temperature of syrup in the syrup system 14, the ambient temperature at the pour head 16, the time the syrup has been in the conduit 24, and the thermal transfer characteristics of the system, particularly the conduit 24. The ambient temperature may either be assumed for a particular site, or may actually be monitored by means of a thermistor or thermocouple 31 within the head 16.

Figure 2:
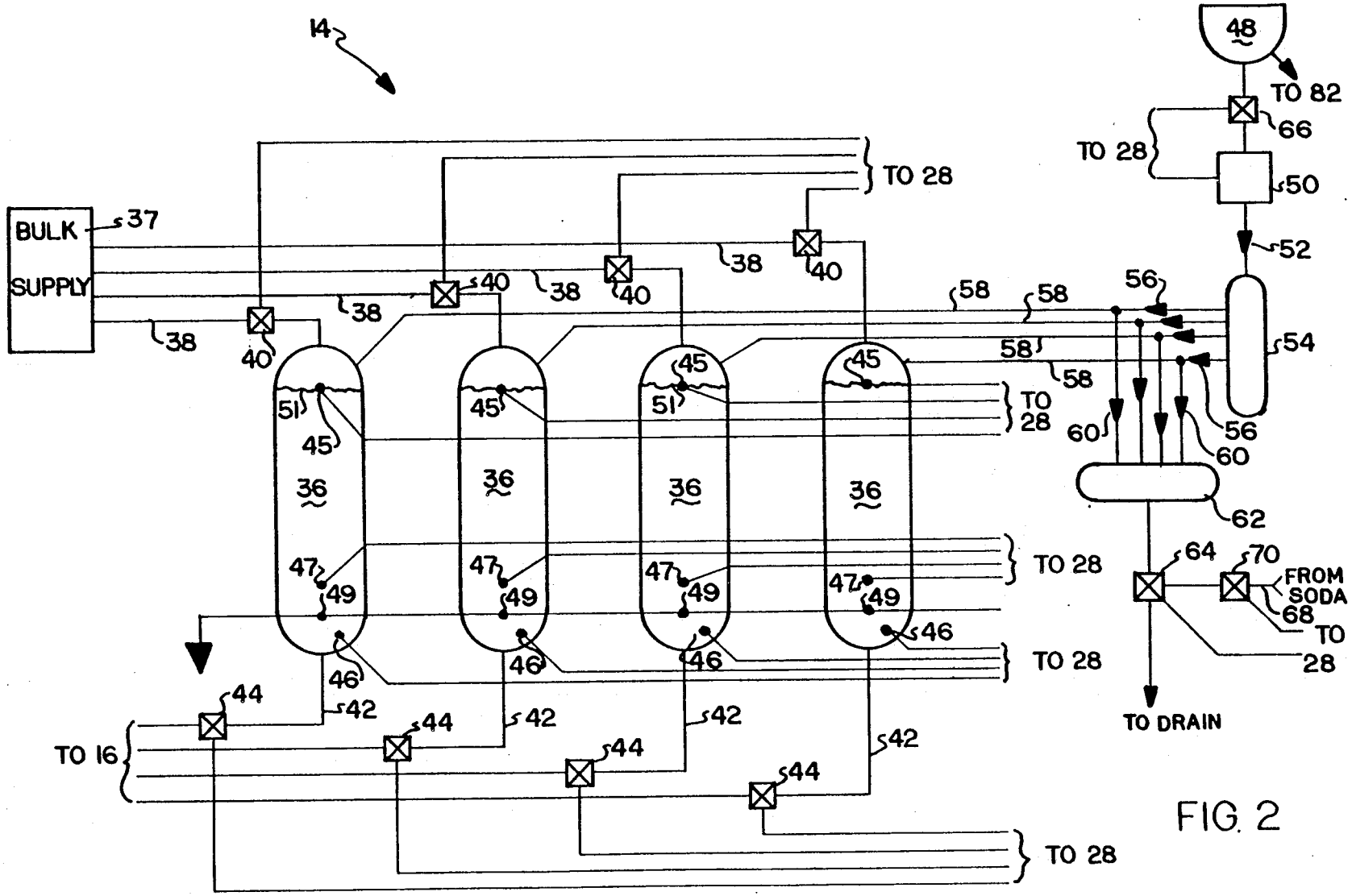
FIG. 2 is an illustrative block diagram of the syrup system of the invention.

With reference now to FIG. 2, the details of the syrup pump system 14 may be seen. As shown, a plurality of syrup reservoir pumps 36 are provided in communication with pressurized bulk syrup tanks or other suitable supply 37 through conduits 38. Maintained within each of the conduits 38 is a fill valve 40 which is controlled by the microprocessor 28. The fill valves 40 are typically solenoid control valves, energized in standard fashion.

Dispensing conduits 42 extend from the bottom of each of the reservoir pumps 36 and extend to the dispensing head 16 of FIG. 1. Positioned within each of the conduits 42 is a dispensing valve 44, again under microprocessor control. Actuation of any of the dispensing valves 44 allows syrup to pass from the associated reservoir pump 36 to the dispensing head 16 when the pump 36 is pressurized as will be discussed below.

Also included as a portion of the syrup reservoirs 36 are thermistors 46 which are maintained within the reservoirs for monitoring syrup temperature. The thermistors communicate with the microprocessor 28 to provide the appropriate temperature signal thereto. As discussed above, the temperature signal as used by the microprocessor to make temperature compensation for the syrup to be dispensed.

Included as part and parcel of the invention is a $CO_2$ pressurized source 48. A solenoid valve 66, under control of the microprocessor 28, communicates with the source 48 to allow $CO_2$ to pass to the transducer 50. As discussed above, the transducer 50 may be a voltage to pressure or a current to pressure transducer which communicates with the microprocessor 28 for purposes of adjusting or regulating the pressure head within the reservoir pumps 36 to compensate for syrup temperature as monitored by the associated thermister 46. The $CO_2$, under regulated pressure, passes through the check valve 52 and the pressure manifold 54 as shown. From there, the pressurized $CO_2$ passes through a check valve 56 maintained in an associated conduit 58 which communicates with a respective one of the reservoir pumps 36. Accordingly, when the solenoid valve 66 is actuated, the pumps 36 are pressurized with a head of $CO_2$ at a pressure regulated for temperature compensation by the transducer 50. When the selected dispensing valve 44 then opens, syrup is dispensed for such period or periods as the valve remains open. When the dispensing cycle is completed, the $CO_2$ may be exhausted through the check valves 60 and the exhaust manifold 62 under control of the three-way solenoid valve 64. Also connected to the three-way solenoid valve 64 is a soda water conduit 68, controlled by a solenoid valve 70. Both the solenoid valve 70 and the three-way valve 64 are controlled by the microprocessor 28. To assure that the syrups of the pumps 36 do not become carbonated, the $CO_2$ head on each of the pumps 36 is exhausted after each dispensing cycle or periodically under control of the microprocessor 28. For example, the three-way solenoid valve 64 may be actuated to vent the pumps 36 every 3 minutes. To cleanse the valve 64, valve 70 is periodically actuated to flow soda from the soda system 12 through the valve 64 and to a drain as shown.

With continued reference to FIG. 2, it will be seen that each of the reservoir pumps 36 includes an upper level sensor 45, lower level sensor 47, and a ground reference 49, all of which pass to the microprocessor 28 for purposes to be discussed hereinafter. Suffice it to say at this time that when the reservoir pumps 36 are full, the syrup therein is maintained at the level 51, coplanar with the upper level sensors 45. It should also be apparent that each of the reservoir pumps 36 would typically have a different syrup therein, fed from a respective canister or daisy chain of canisters from the bulk supply 37. While all of the pumps 36 are pressurized together as through the manifold 54, syrup is dispensed through the head 16 only from the pump 36 whose associated dispensing valve 44 is opened under control of the microprocessor 28. That valve is determined by the beverage selection made on the button board 30.

Figure 3:
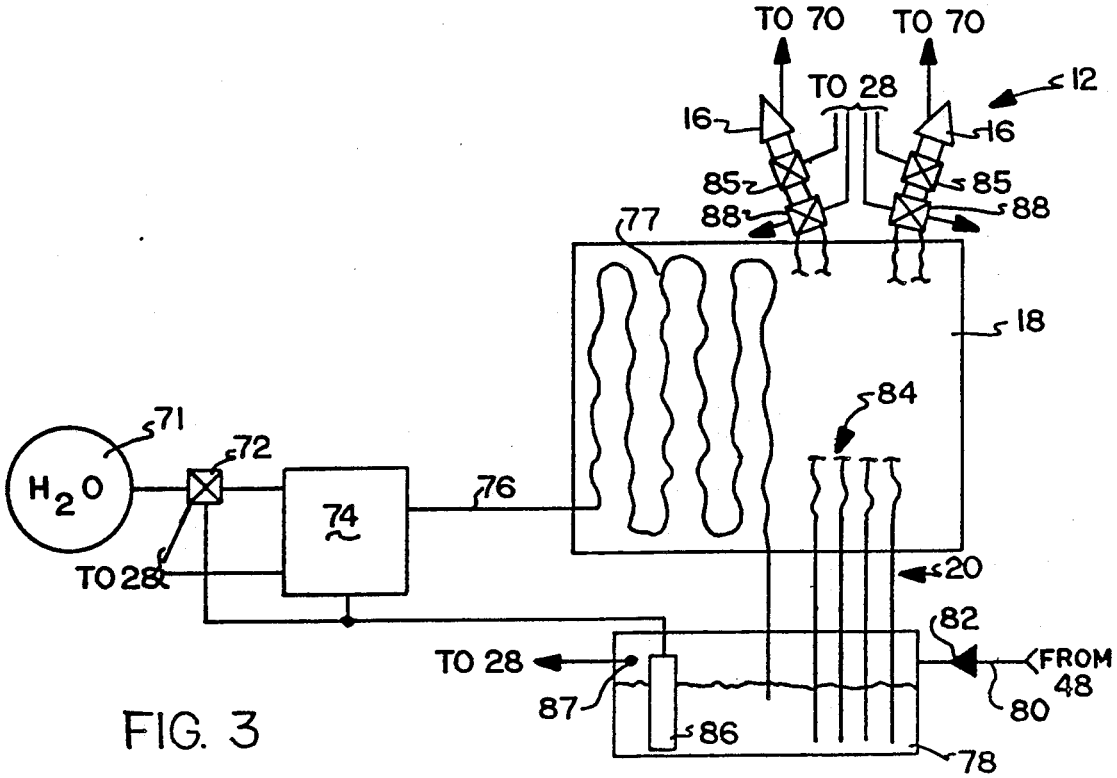
FIG. 3 is an illustrative block diagram of the soda system of the invention.

With reference now to FIG. 3, a detailed description of the soda system 12 may be seen. As shown, water is introduced from a source 71 through a pressure switch 72 to a pump 74 which passes water under high pressure through a conduit 76 to the ice plate 18 where it is cooled as it passes through serpentine passages 77. The cold water from the ice plate 18 then passes to an insulated carbonation tank 78 where $CO_2$ is introduced into the water under high pressure through the conduit 80 and check valve 82. The pump 74 is provided to drive the water into the pressurized tank 78, while the check valve 82 serves to prevent a backflow of $CO_2$ or water to the $CO_2$ pressurized supply 48. It will also be appreciated that an appropriate regulator may be maintained at the supply 48 to assure that the $CO_2$ pressure to the tank 78 is always at a preset level such as, for example, 100 psi.

The resulting carbonated water is then passed via the conduits 20 to the ice plate 18 for dispensing through the heads 16 after being further cooled or chilled by passing through serpentine passages 84. As shown, the system of FIG. 3 feeds two dispensing heads 16, but any number might be so employed, each fed by the syrup pumps 36 and controlled by the microprocessor 28. It should be observed that a float switch 86 is maintained within the tank 78 and is operative for actuating the switch 72 and pump 74 to cause additional water to be pumped into the tank 78. In other words, the float switch 86 guarantees that the tank 78 is maintained at a full level.

The carbonation level of the soda or water in the tank 78 is a function of time, temperature, and pressure. By precooling the water through the passages 77 of the plate 18, the water in the tank may be more efficiently carbonated. Similarly, with the soda in the tank 78 at a low temperature and with the tank 78 insulated, the efficiency of the cold plate 18 is enhanced as the soda passes through the passages 84 to the heads 16. This is of great benefit for servicing peak periods when large volumes of soda need to be dispensed.

To assure efficiency of the soda system 12, a solenoid valve 88 is interposed at the head 16 between the tank 78 and a drain. At the beginning of a day, or in the event that the microprocessor 28 senses that a minimum volume of soda has not been dispensed in a given period of time, the tank 78 is emptied and refilled with fresh soda at a lower temperature. This is done because the temperature of the soda, if not frequently replenished, will rise with time and the soda will become flat. To accomplish this, the microprocessor 28 inhibits the valve 72 and pump 74 while opening the valve 88 to empty the tank to the drain. The valve 88 is then closed and the valve 72 and pump 74 are then cycled to gradually fill the tank 78 with cold water for carbonating. The rate of cycling is, of course, dependent upon the efficiency of the cold plate 18. Accordingly, a reserve of cold soda is available for the beginning of the day's operations, and for peak periods. A smaller cold plate 18 may thus be used than heretofore, and wear on the pump is minimized.

It is also contemplated that the invention will reduce the affects of ambient temperature upon the soda by periodically allowing a bypass flush of 3–4 ounces of soda during periods of non-use, thus causing the carbonator tank 78 to recycle. Typically, the tank 78 will recycle when between 20 and 80 ounces of soda has been withdrawn from the tank 78, depending upon the nature of the float switch 86. With microprocessor 28 purging 3–4 ounces of soda from the carbonator tank through the solenoid valves 88 ever 3 minutes, for example, the carbonator tank 78 may be caused to recycle every 20–80 minutes, guaranteeing the tank 78 to be filled with cold and effectively carbonated soda. Of course, it is contemplated that such a purge only be engaged by the microprocessor 28 when neither a dispensing cycle nor a purge cycle has not been engaged for such a three minute period. This purging feature allows for the cooling of the "casual" drink, those dispensed during periods of infrequent use of the soft drink dispenser. In the prior art, without the purging feature, the soda warmed up in the lines between the carbonator tank and dispensing head, resulting in warmer "casual" drinks with lower carbonation levels. With the purging of the instant invention, a constantly cold reservoir of carbonated water is maintained up to and through the dispensing head 16.

As shown, solenoid valves 85 are interposed in the soda lines at the head 16 to allow soda to pass to the heads 16 under microprocessor control. In a preferred embodiment of the invention, and as will become more apparent hereinafter, each pour head 16 includes 28 openings or passages for dispensing soda, each opening communicating with a separate tube or conduit 20. Preferably, the tubes are arranged in 4 groups of 7 each, there being one solenoid valve 85 for each group, or 4 such valves per head 16. It is further contemplated that the valves 85 may be duty cycled or otherwise controlled by the processor 28 to compensate for changes in head pressure in the tank 78 from the preset level. Such changes may occur, for example, from the refilling of the tank 78 with water under pressure from the pump 74. For such purposes, a pressure transducer 87 may be maintained in the tank 78 and in communication with the processor 28 which maintains a table of soda flow rates as a function of head pressure. The processor 28 may then control a duty cycle for the operation of one or more of the 4 valves 85 to achieve the desired compensation as a function of the sensed pressure.

Figure 4A:
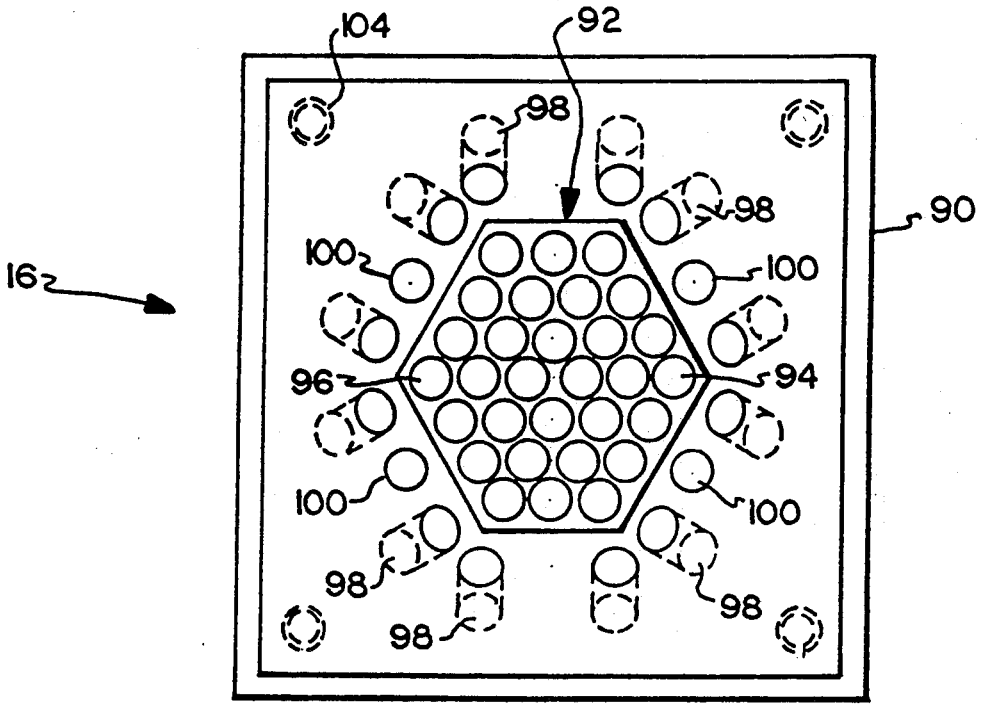
FIG. 4A is a bottom plan view of the dispensing head of the invention.
Figure 4B:
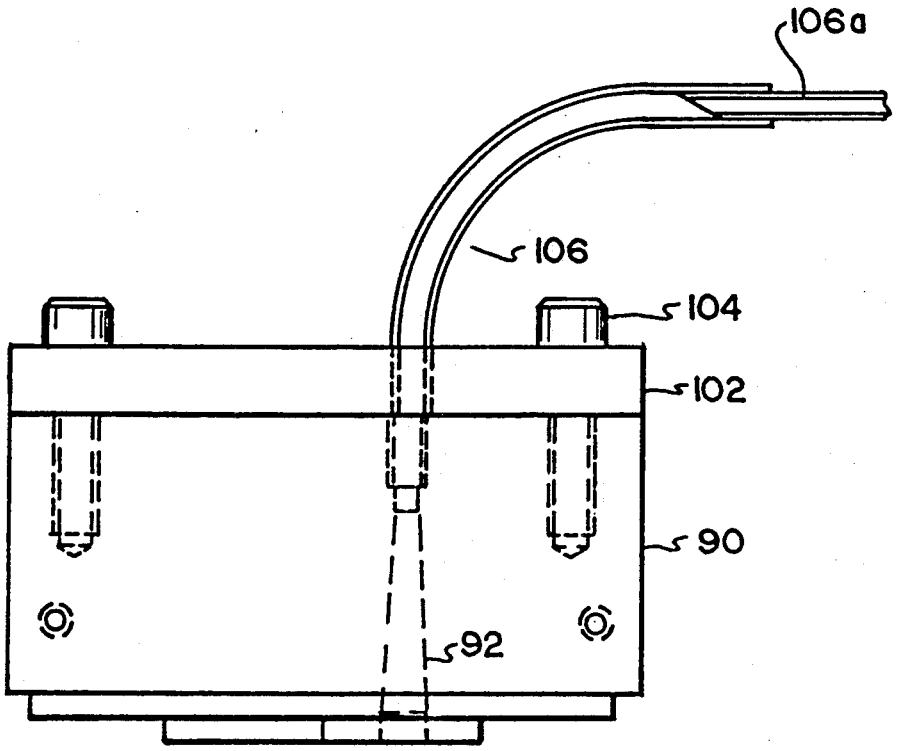
FIG. 4B is a partial sectional view of the dispensing head of the invention showing the tapered nozzles thereof.

With reference now to FIGS. 4A and 4B, the detailed physical structure of the pouring head 16 may be seen. As seen from the bottom plan view of FIG. 4A, the head 16 comprises a block 90 of plastic or other suitable material which will not adversely affect food products. Centrally positioned in the block 90, passing therethrough, and opening at the bottom thereof, are a plurality of passages 92 maintained in hexagonal configuration. In the preferred embodiment, there are 30 such passages 92, although the specific number may vary within a reasonable range. In the preferred embodiment, the vast majority (28) of the passages maintained in the hexagonal configuration are used to dispense soda or carbonated water. However, a minimum number of such passages may be used for dispensing pure water. In the preferred embodiment, the outermost passages 94,96 are so used.

Positioned about the periphery of the configuration of passages 92 are a plurality of passages 98 of uniform cross section, but which angle away from the edges of the block 90 as they pass from the top of the block through the bottom. The passages 98 form an angle of 7°–15°, and preferably 11 degrees with the vertical as they pass through the block 90. The opening in the top of the block and the course of the passages 98 through the block are shown in phantom in the drawing. In the preferred embodiment, there are 12 such passages 98 which are typically used for dispensing the sugar-containing or high brix syrups for blending with the soda for the formulation of a soft drink. It will be noted that the high brix passages 98, while angled away from the edges of the block 90, are not angled toward the center of the hexagonal configuration)of the passages 92, but are purposefully angled away from such center at the corners of the hexagonal configuration of the passages 92. As will be discussed hereinafter, such a configuration achieves the most effective and efficient dispensing of the high brix soft drink. While the passages 98 are interposed particularly for the purposes of dispensing syrups, it will be understood that one or more such passages may be used for dispensing water if additional water sources are desired for purposes of reducing the carbonation level for particular drinks.

Interposed in alignment with the passages 98, about the periphery of the hexagonal configuration 92, are a plurality or passages 100 which are adapted for dispensing syrups for diet soft drinks such as low or zero brix syrups. The passages 100 pass straight through the block 90, parallel to the edges thereof, and are not angled with respect to the passages 92. The separation between the diet soft drink syrups and the soda is maintained until entry into the glass or other receptacle since diet drinks are known to mix easier than high-brix drinks. Further, diet syrup is more likely to generate foam when combined with soda than is a high-brix syrup and, accordingly it is particularly important to maintain the separation between the diet syrup and the soda until entry into the glass, with the mixing being achieved upon the ice. It will, of course, be understood that the passages 98,100, while being designated for syrup, may alternately be used for water, juices, iced tea, or other suitable component or beverage.

As best shown in FIG. 4B, a cover plate 102 is secured to the top of the block 90 by a plurality of cap screws 104. As further shown in FIG. 4B, each of the passages 92–100 communicates with its source of component such as soda, water, syrup, or the like by means of a flexible or elastic tube 106 such as TYGON tubing which receive the valves 44,85 as previously discussed. Accordingly, the cover plate 102 has a plurality of passages for receiving the tubing 106 for receipt by the associated passages 92–100. A novel feature of the invention is the fact that the cover plate 102 is used to crimp or otherwise secure the plurality of tubes 106 to prevent their withdrawal from their associated passage. This is achieved by offsetting the passages in the cover plate 102 which receive the tubing 106 from the passages in the block 90 which receive the tubing 106. As shown in FIG. 4B, when the openings in the cover 102 and block 90 which receive the cap screws 104 are in alignment, the passages in the cover 102 and block 90 which receive the tubing 106 are offset on the order of 0.002–0.010 inch and preferably 0.005 inch. This offset crimps the tubes 106 and prevents their retraction.

It should also be noted with reference to FIG. 4B that the passages 92 for soda or carbonated water are flared outwardly to provide an increasing diameter as they pass through the block 90. In a preferred embodiment, the flare angle is 20°–30°, and preferably 24°. For purposes of approximation, the diameter of the passages 92 increases from 0.125 inch to 0.25 inch over a path of 1.125 inch. The purpose of this flare or doubling of the diameter of the passage 92 is to reduce the velocity of the carbonated water or soda as it passes through the dispensing head 16 to achieve a gentle flow of the soda, greatly reducing the turbulence of the flow and the resulting foaming action.

With continued reference to FIG. 4B, it will be noted that the tubes 106 for passing carbonated water or soda receive therein a tube **106*a* which has an outside diameter substantially equal to the inside diameter of the tube 106, both tubes preferably being of the same elastic material and nature. It will also be noted that the tubes 106,106*a* are married or joined near a bend in the tube 106 which defines the path taken by the soda prior to entry into the cap 102 and block 90. It will also be noted that the end of the tube 106*a* received within the tube 106 is cut on a bias of 30°–60° and preferably 45°. Such structure has been found to reduce turbulence in the flow of the soda and to facilitate a soft flow of such soda from the block 90**. It will be appreciated that turbulence in the soda flow will result in an effervescence or foaming of the soda as energy is released in the escape of the entrained $CO_2$ gas.

With the tube 106 having a larger inside diameter than that of the tube 106*a*, the rate of flow of the soda slows upon reaching the tube 106, allowing the soda to become less dynamic and to achieve the "soft" flow desired. With the end of the tube 106*a* being cut on an angle or bias, the soda is directed onto and along the inner wall of the tube 106, rather than jetting into the curve which the tube 106 takes as it enters the cap 102. Accordingly, the soda takes a laminar, rather than turbulent flow through the curve. Additionally, the bias cut allows for a gradual, rather than abrupt, change in the diameter of the flow path, again reducing turbulence and the likelihood of escape of the $CO_2$ gas.

Figure 5:
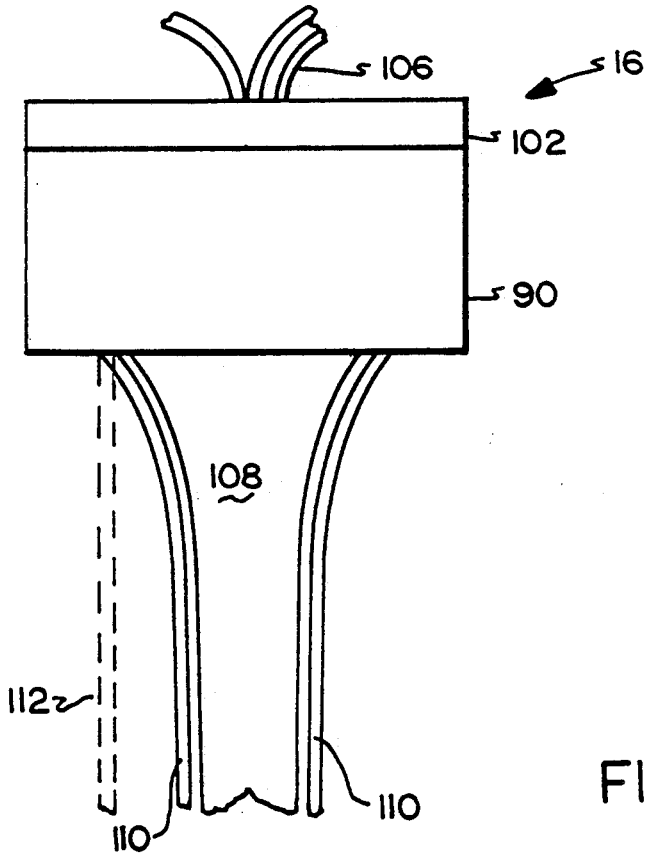
FIG. 5 is an illustrative showing of the flow pattern of the dispensing head of the invention.

With reference to FIG. 5, an appreciation of the flow pattern from the dispensing head 16 may be seen. As shown, a plurality of tubes 106 communicate through the assembly 90,102 to provide for soda, water, syrups and the like for dispensing into a cup or other receptacle. The soda, dispensed from the passages 92 in the center of the block 90 holds a rather tight flow path 108 which is conical as it leaves the block 90 and becomes substantially cylindrical thereafter, as shown. It is known that this is characteristic of soda in that the soda has an affinity or attraction for itself and holds a rather tight pattern in freeflow. This is further achieved by maintaining the openings of the passages 92 at the bottom of the block 90 in close tangential proximity to each other, as shown. Preferably, such openings are either tangential or separated from adjacent openings by less than 0.010 inch. The high brix syrups from the angled passages 98 follow a stream or path which is convoluted with respect to and adjacent the soda flow path 108 such that the syrup and soda stay a fixed distance apart until they reach the ice of the glass. By mixing the two upon the cold ice, the mixing action is less volatile and less likely to foam. The more volatile diet syrups, emitted from the passages 100, preferably follow the flow path 112 which is substantially a straight vertical drop from the dispensing head 16, separated further from the soda path 108, to assure that mixing does not occur until reaching the cup of ice. Again, the coldness of the ice restricts the volatility of the mix. The paths of the syrups are defined by the passages 98,100 discussed above.

The constant spatial and angular relationship between the syrups and soda insures that the syrups and soda strike the surface of the ice at predetermined distances from one another and at predetermined velocities, regardless of the ice level. The invention allows for various syrups to be dispensed with their own unique best spatial and angular relationship to the soda to reduce foaming and stratification.

Figure 6:
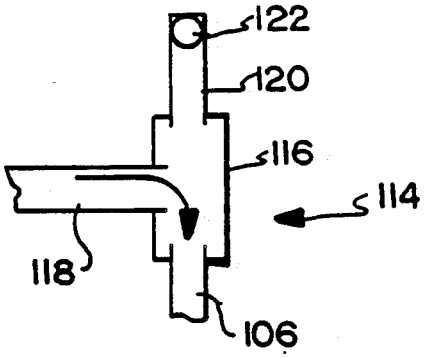
FIG. 6 is a partial sectional view of a hydraulic accumulator according to the invention.

An important feature of the invention is the provision of means for preventing a syrup of one composition to mix with a drink of another. As is apparent from FIG. 4, the dispensing head 16 includes a plurality of different syrup nozzles or passages. If syrup from one of those passages were to drip into a glass receiving a beverage not to include such a syrup, the quality and integrity of the drink would be greatly impaired. Accordingly, each or the syrup tubes 106 is provided with a hydraulic accumulator 114 as shown in FIG. 6. The hydraulic accumulator includes a housing 116 from which extends the dispensing tube 106. Entering the side of the housing 116 is a tube 118 which communicates with the associated pump 36 for the specific syrup. Extending from the top of the housing 116 is an elastic tube 120 which receives therein a ball 122 having a diameter substantially equal to or slightly greater than the inside diameter of the tube 120. Accordingly, the ball 122 is pressfit or snugly received within the tube 120 and serves to seal the end thereof.

In operation, when the appropriate solenoid valve 44 is actuated, syrup under pressure is dispensed from the the appropriate pump 36, through the conduit 42 and valve 44, and into the tube 118. This forceful flow of syrup through the housing 116 creates a slight vacuum in the tube 120 which slightly collapses. When the flow stops, the vacuum in the tube 120 seeks to reach a point of pressure equilibrium and can do so only by expansion of the elastic tube 120 to its quiescence state. When this occurs, the syrup in the dispensing tube 106 is slightly withdrawn, creating a concave surface at the end of the nozzle in the dispensing head 116 and maintained in that posture by surface tension and the quiescent state of the hydrualic accummulator 114. Accordingly, there is no dripping of unwanted syrup into dispensed beverages.

It is further contemplated that with the syrup dispensing tubes 106 being elastic such as of Teflon or an appropriate fluorastomer, the hydraulic accumulator 114 may be eliminated with the tubes 106 serving the same function. In such a case, when a valve 44 opens, the pressurized syrup within the associated tube 106 causes such tube to expand slightly as the syrup flows. At the end of the dispensing cycle, the valve 44 snaps shut, but the momentum of the syrup within the tube causes the syrup in the tube to continue its flow for a slight period, during which time the tube 106 begins to collapse as the kinetic energy of the syrup flow dissipates. When the momentum and flow terminates, the elastic nature of the tube 106 causes the tube to expand to its original diameter, withdrawing the syrup from the end of passages 98,100 in a concave manner in which they are held by the quiescent state of the tube 106 and surface tension. For such purposes, the tubes 106 may extend through the passages 98 within the block 90, terminating flush with the bottom of the block 90.

It has been found that the hydraulic accumulators 114 work best with low viscocity diet syrups, while a hydraulic accumulator as defined in the immediately preceeding paragraph is best suited for implementation with higher viscocity high brix syrups.

Figure 7:
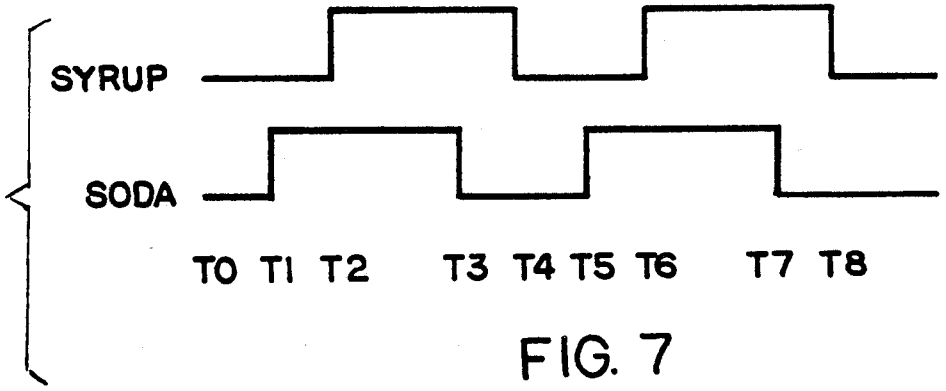
FIG. 7 is a timing chart for the syrup and soda dispensing cycles according to the invention.

Utilizing the dispensing system as described above, certain unique features are attainable. To begin with, foaming is substantially eliminated by the absence of a diffuser in the pouring head and by allowing the soda and syrup to mix on the ice in the cup itself. By having the soda already at a low temperature by passing it through the ice plate 18, and by mixing it with the syrup on the cold ice, foam is substantially eliminated and hence the drinks may be poured much more rapidly. To maximize the mixing feature and to minimize foaming, phasing of the syrup and soda dispensing cycles has been discovered to be most beneficial. Such cycling is shown for a preferred embodiment of the invention in FIG. 7. As shown at time T0 a selection has been made at the button board 30 as to the type and size of soft drink. At time T1 the pour switch 26 is actuated by a cup or othewise, and the dispensing cycle begins by pressurization of the pumps 36, and selective actuation of appropriate valves 52,44 and the like as previously discussed. Initially, only soda is dispensed (T1), followed by a concurrent dispensing of soda and syrup (T2), followed by a period of syrup only (T3). For a short period of time (T4), nothing is dispensed, allowing any foam which might have generated to settle. Subsequently, soda alone is dispensed (T5), followed by a concurrent dispensing of soda and syrup (T6), followed by a final float of syrup alone (T7). This float gives strength to the drink at the top which normally would be the weakest part of the drink.

Again recalling that foaming is a result of the combining of syrup and soda, those portions of the dispensing cycle in which either soda alone, syrup alone, or nothing is being dispensed will allow whatever foam was previously generated to settle. The desired control can be readily achieved by a timed actuatation of the dispensing valves 44 under control of the microprocessor 28, which are the same valves to be regulated to a achieve a desired dispensing duty cycle to compensate for temperature variations in a manner discussed earlier herein.

Yet a further capability of the instant invention is the dispensing of low carbonation drinks. It is known that a standard carbonated beverage contains 3.4–3.6 volumes of $CO_2$ per volume of liquid A low carbonated drink would typically have on the order of 2.2–3.0 volumes of $CO_2$ per volume of liquid It has been found that low carbonation drinks may be dispensed, for example, by actuating three soda valves and one water valve at the same time, thus diluting the soda by $\frac{1}{3}$. When this is done, the rate of syrup dispensing is increased as by an increase of voltage and pressure at the transducer 50. By accelerating the rate of syrup pour proportionately to the increase of soda/water pour, the proper sweetness ratio or brix may be maintained. Obviously, the ratio of water to soda which is to be dispensed for any drink bears a relation to the degree of carbonation of the desired drink. The control of the particular soda and water valves can, of course, be properly achieved via the microprocessor 28.

As shown in FIG. 2, each of the reserviors 36 has an upper level sensor 45, a lower level sensor 47, and a ground lead 49. The sensors 45,47 are passed to the microprocessor 28 and are operative to determine when the pump 36 is full or when operation of the same has erred. In a desired mode of operation, as soon as the level in the pump 36 drops below the top sensor, indicating that a drink has just been poured, a 20-second timer is started by the microprocessor 28. At the end of the dispensing cycle, the pumps 36 are vented by the solenoid valve 64 to release the pressurization of the $CO_2$ gas. At the same time, the valve 40 associated with the pump from which syrup was dispensed opens to replenish the syrup in the pump from the bulk supply 37 until the microprocessor 28 senses via the sensor 45 that the pump is full or until a new dispensing cycle is commenced. In either event, the microprocessor 28 terminates the refilling operation by closing the valves 40,64. If the 20-second timer times out, it is indicative that there is a problem with the pump 36 and that pump is rendered inactive. The pump is rendered inactive so that it is not totally depleted of syrup. Also, if the source container of pressurized syrup at 37 is empty, this feature prevents the pump 36 from exhausting $CO_2$ gas for more than 20 seconds, thereby eliminating the possibility of depleting the $CO_2$ supply while trying to fill a pump with no supply syrup available. The processor 28 advises the operator of this condition by means of a blinking light on the button board associated with the syrup. Should the operator ignore the signal and attempt to dispense a finished beverage with such syrup, the processor 28 will disallow the dispensing of both that syrup and carbonated water. This is a significant advantage over prior art "sold out" sensors or displays, particularly for clear syrups where the absence of syrup is not immediately apparent.

Each time a dispensing cycle is initiated as by actuation of the pour switch 26, the timer starts anew. The top sensor 45 must be contacted with syrup within twenty seconds of the last disbursement or the associated pump 36 is shut down. The twenty second time period is somewhat arbitrary, it being understood that in a preferred embodiment, the entire pump 36 could be filled from a totally dry position to a position where it is filled to the top sensor 45 in approximately 12 seconds. Accordingly, the twenty second time limit provides a safety factor.

In like fashion, the bottom sensors 47 determine when the level of syrup in the pump 36 is dropped to an unreasonably low level. When the syrup drops below the sensor 47 in any of the pumps 36, it is indicative that the pump is out of syrup and the pump is then shut down and operations switched to another of the pumps 36 which may contain the same syrup. Obviously, the contacts 49 are simply for ground reference and, as will be understood by those skilled in the art, the syrup within the container 36 is used as a conductor to pass electrical signals from the contacts 45,47 to ground 49. It should also be understood that the top level sensor 45 is used as a means for closing the associated fill valve 40. As soon as that desired level of syrup has been reached the microprocessor 28 senses that condition and closes the valve 40 to prevent further entry of syrup into the reservoir pump 36.

When the bottom sensor 47 indicates to the microprocessor 28 that the level on the associated pump 36 is below the level of that sensor, the associated pump 36 is disabled and an indication is made on the button board 30 that the bulk supply 37 for that syrup must be replenished. In such instance, the empty canister is removed from the bulk supply 37 and replaced with a new canister. A button on the button board 30 is then pressed to enter into the refill cycle, during which the microprocessor 28 causes the valve 40 to open and syrup is then passed into the associated pump 36 until the top sensor 45 is reached. During this process, the pump 36 is vented through the exhaust manifold 62 and three-way solenoid valve 64 to allow the refilling to be accomplished. Accordingly, any $C0_2$ gas which was maintained in the conduit 38 or in the pump 36 is exhausted and is prevented from passing through the dispensing valve 44 or tubes 106. Accordingly, there are no "slugs" in the line, no syrup is wasted, and the quality and integrity of the drink remains constant. In other words, the syrup is totally consolidated or rechambered in the pumps 36 and the dispensing head is isolated from any empty canisters in the bulk supply 37.

In operation, the operator selects a beverage as to both type and volume from the button board 30. The microprocessor 28 senses the selection and prepares itself for dispensing. When the operator places a cup filled with an appropriate amount of ice under the pouring head 16 and contacts the pour switch 26, the microprocessor receives a signal advising it to enter into the dispensing cycle. The pumps 36 are then pressurized by means of the solenoid valve 66 and pressure transducer 50 through the pressure manifold 54. An appropriate one of the dispensing valves 44 is then actuated by the microprocessor 28 as is an appropriate solenoid valve 85 to respectively allow the flow of syrup and soda into the cup. This flow is achieved according to the timing chart set forth in FIG. 7 and discussed above. At the termination of the dispensing cycle, with the valves 44,85 closed, the pumps 36 are vented through the exhaust manifold 62 and under control of the three-way solenoid valve 64 to depressurize the pumps 36. The system is then available for a subsequent dispensing cycle.

It should be thus apparent that the instant invention provides for a soft drink dispensing system which is capable of dispensing a large variety of soft drinks from a single dispensing head in a time efficient manner. Foaming is significantly reduced, if not eliminated, such that a full measure of beverage may be dispensed in a minimum amount of time. Rechambering and consolidation of the syrups within individual pumps 36 prevent "slugs" from entering the line and guarantee beverage consistency from one dispensing cycle to another. Additionally, consistency is maintained irrespective of line lengths or ambient temperature by virtue of the consolidation of the syrup within the pumps, the monitoring of the temperature of the syrup with subsequent pressure modification, and the monitoring of the head pressure on the carbonated water with subsequent time adjustments. By providing a hydraulic accummulator with each of the syrups, there is no intermixing of syrup from one drink to the next. The pumps are frequently exhausted such that the syrup itself does not become carbonated or volatile, further adding to the stability of the system. Finally, by maintaining the flow of syrup and soda separate from each other and allowing the drink to mix upon the cold ice, foaming and turbulence are greatly reduced.

As should be apparent from the foregoing, the control of the dispenser of the invention is achieved by the microprocessor 28. While various functions of such control have been illustratively set forth above, it should be understood that different methods of control may be employed to achieve the same end results. In accordance with the invention, there is presented in FIGS. 8–15 a flowchart setting forth the program control of the microprocessor 28 in sufficient detail to enable a person skilled in the art to appreciate the operation of the same.

Figure 8:
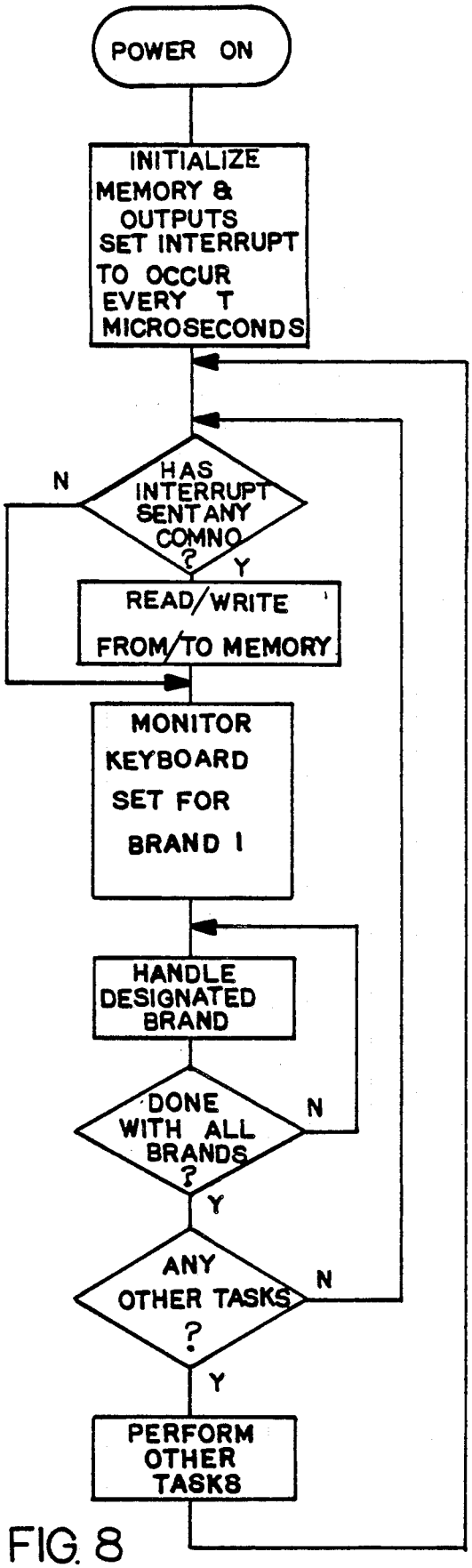
FIG. 8–15 comprise a flow chart diagram of the control program utilized in the invention by the microprocessor.
Figure 9:
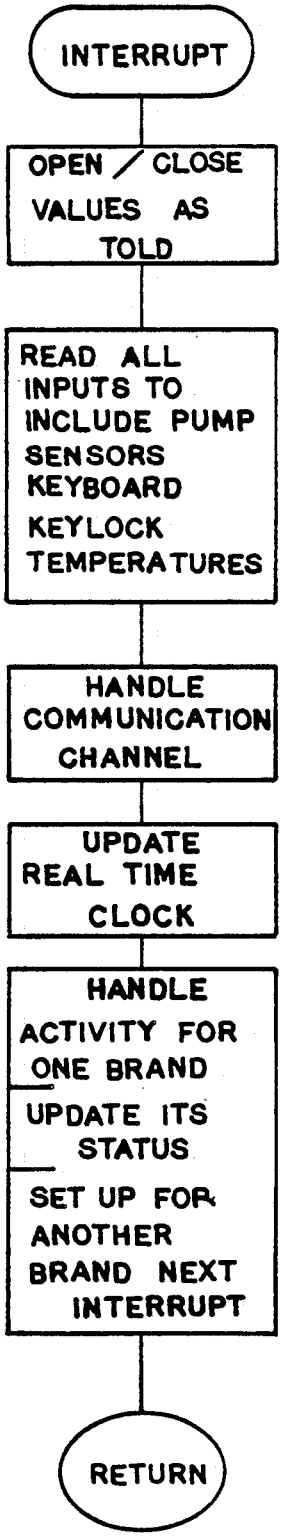
Figure 10:
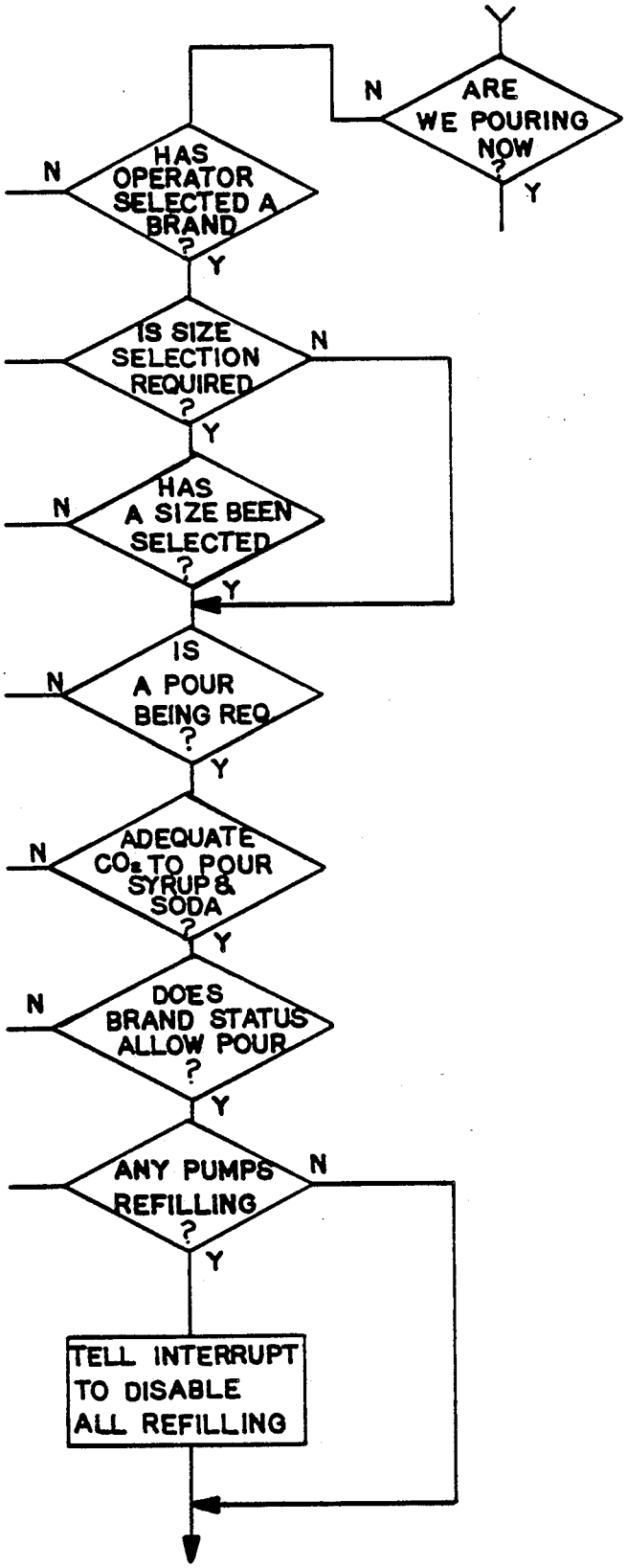

With reference to FIGS. 8 and 9, an appreciation of the general overall system may be obtained. As shown in FIG. 8, when power is turned on the memory and outputs are initialized, and the Interrupt routine is set to occur every T microseconds. When the Interrupt subroutine has sent a communication, the memory is accessed for read or write operations. Upon conclusion of memory access, the keyboard is monitored and the system is set to handle one of the selected brands of a beverage. That brand is then "handled" in the block designated "Handle Designated Brand" in a fashion which will be discussed in part hereinafter. The system then determines whether or not all brands have been so handled and, if not, the cylce loops until all such brands have been completed. Upon completion, determination is made as to whether or not any other tasks need to be performed. If so, such tasks are performed and the routine of FIG. 8 returns to await the next communication from the Interrupt subroutine. If no other tasks were required, the same return is made.

The Interrupt subroutine is shown in FIG. 9. It will be seen that this subroutine opens and closes the various valves of the system as advised from memory dependent upon the beverage dispensed or to be dispensed. The Interrupt subroutine also reads all the inputs which include the pump sensors, the keyboard, a keylock function, temperatures of the syrups and soda, and the like. The communication channel is also handled in the Interrupt subroutine in the event that a host computer is employed. The real time clock is also updated for setting actual times used in the dispensing, refilling, and similar operations. Finally, the Interrupt also handles the activity for a specific brand of beverage, updates that brand's status and sets itself for handling another brand on the next Interrupt. This final block of the Interrupt subroutine is presented in further detail below with respect to FIG. 15. At the conclusion of the Interrupt subroutine, return is made to the overall system program of FIG. 8.

FIGS. 10–13 present an expansion on the sequencing of the block designated "Handle Designated Brand" of FIG. 8. As shown, the program determines whether a pouring cycle is presently engaged. If not, a determination is made whether the operator has selected a particular brand or beverage to be dispensed. If the operator has selected a brand, then the determination is made as to whether a size selection for the drink is required. If such a selection is required, a determination is made as to whether or not the size has been selected. In the event that a size selection is not required or that a size selection has been made, the microprocessor then senses the pour switch at the head or a pour button on the keyboard to determine if a dispensing cycle is being requested. If a request has been made, the microprocessor determines whether or not adequate carbon dioxide is available to pour or dispense both the syrup and the soda. If it is, a determination is then made as to whether or not the status of the requested beverage allows for dispensing. In other words, is the pump of that system full, is it operative, or has that beverage been disabled at the keyboard. Next, the system determines whether any pumps are in a refilling cycle and, if they are, the Interrupt subroutine temporarily stops the refilling cycle, closes the appropriate valves, and allows the dispensing cycle to continue as in FIG. 11.

Figure 11:
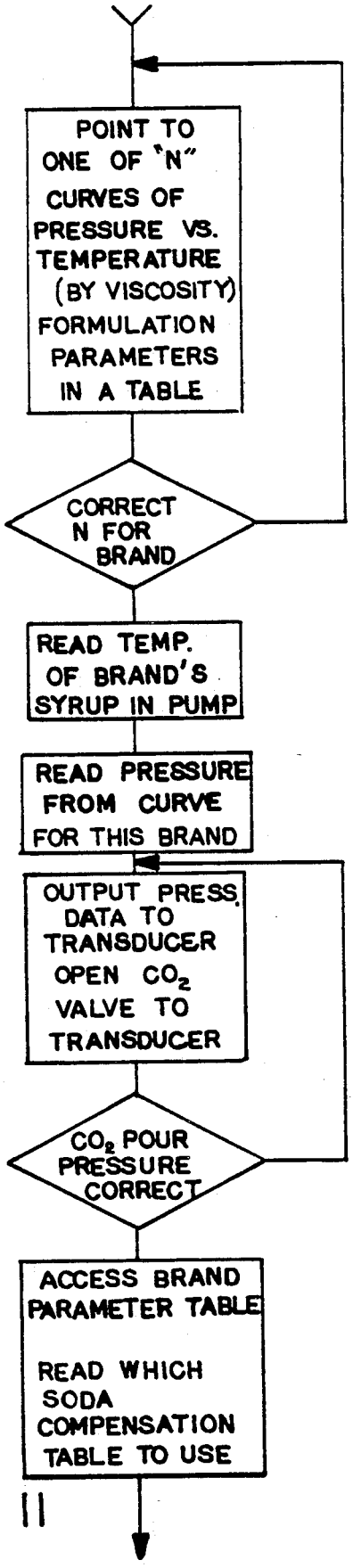

As shown in FIG. 11, the microprocessor 28 points to one of "N" curves of pressure vs. temperature respecting the viscosity of the syrup of the selected beverage. The microprocessor 28 also selects the appropriate formulation parameters from a table, such parameters establishing the number of soda dispensing valves and water dispensing valves to be employed in the particular beverage. If the correct "N" for the desired brand has been selected, the temperature of that brand's syrup in the pump is then read. The appropriate pressure for the temperature of that brand is then read from the curve selected above. The appropriate pressure data is then sent to the transducer to allow the syrup to be appropriately pressurized. The carbon dioxide valve to the transducer is opened to pass the pressure to the syrup pump and a determination is then made as to whether the appropriate pressure head is present on the syrup within the pump. The microprocessor then accesses the brand parameter table which was pointed to in the first block in this figure, and determines which soda compensation table to use.

Figure 12:
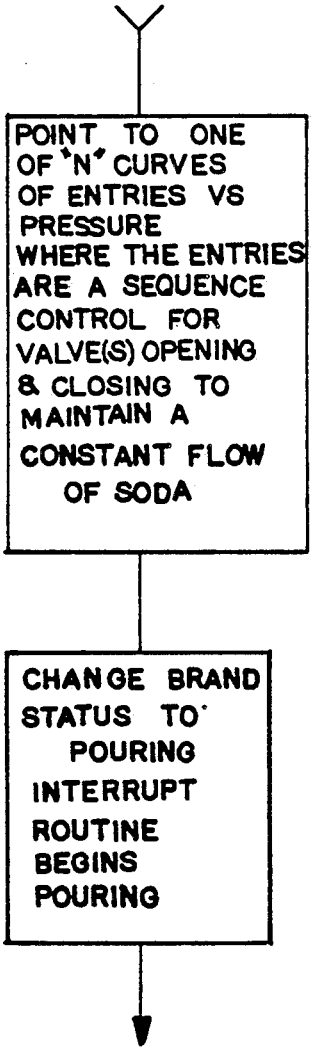

As shown in FIG. 12, the microprocessor then points to one of the "N" curves of entries vs. pressure, where the entries are the sequence control for the valves opening and closing to maintain a constant flow of soda. In other words, the soda is turned on and off to compensate for the pressure head changes in the soda dispensing system. Next, the brand status is changed to "pouring" such that the Interrupt subroutine may actually begin the pouring cycle as shown in FIG. 13.

Figure 13:
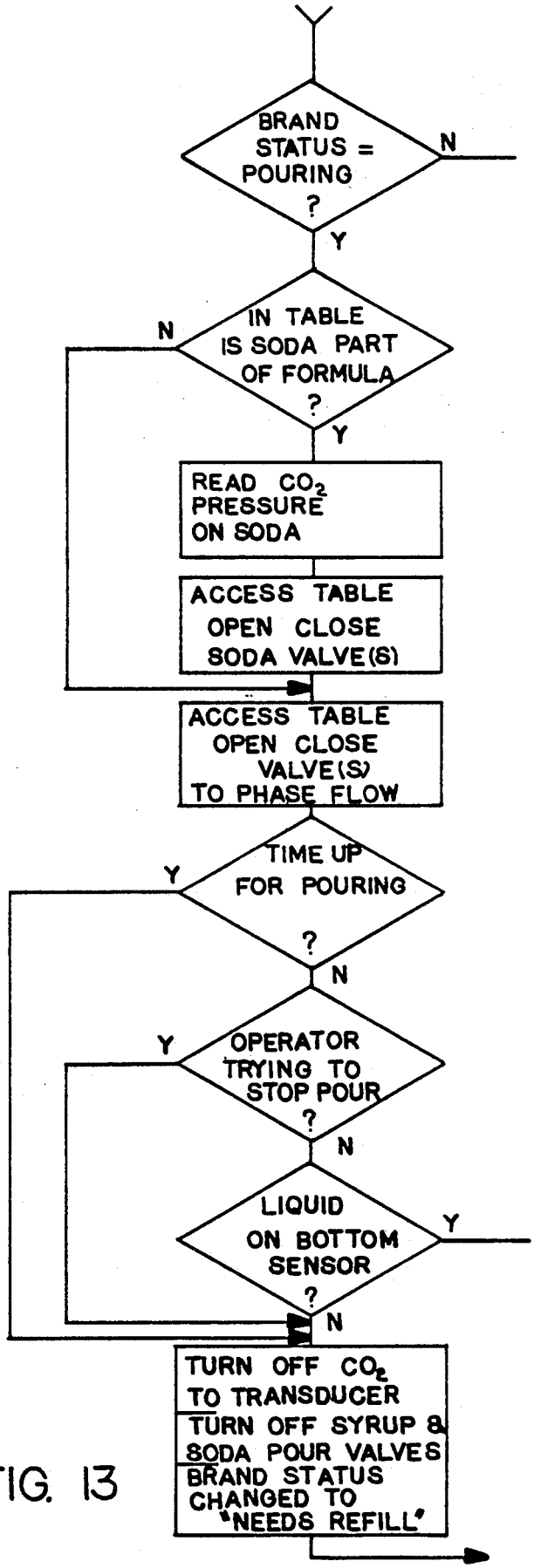

FIG. 13 is an expansion on the pouring process employed in the final block of the Interrupt subroutine of FIG. 9. As shown, when the system is in the pouring status, the initial determination is made as to whether or not soda comprises a part of the formula to be dispensed. If it does, the pressure head on the soda is read and the appropriate table is resorted to for opening and closing the soda valves to achieve the desired pressure compensation. Next, the soda and syrup valves are opened and closed to achieve the desired phased flow to minimize foaming as discussed hereinabove. As shown in FIG. 13, the dispensing cycle continues until it has either timed out, the operator has terminated the cycle, or the bottom sensor has indicated that syrup is no longer available. Once the pouring cycle is terminated, the carbon dioxide to the transducer is cut off, the syrup and soda pour valves are closed and the brand status is changed to indicate the need for a refilling cycle.

Figure 14:
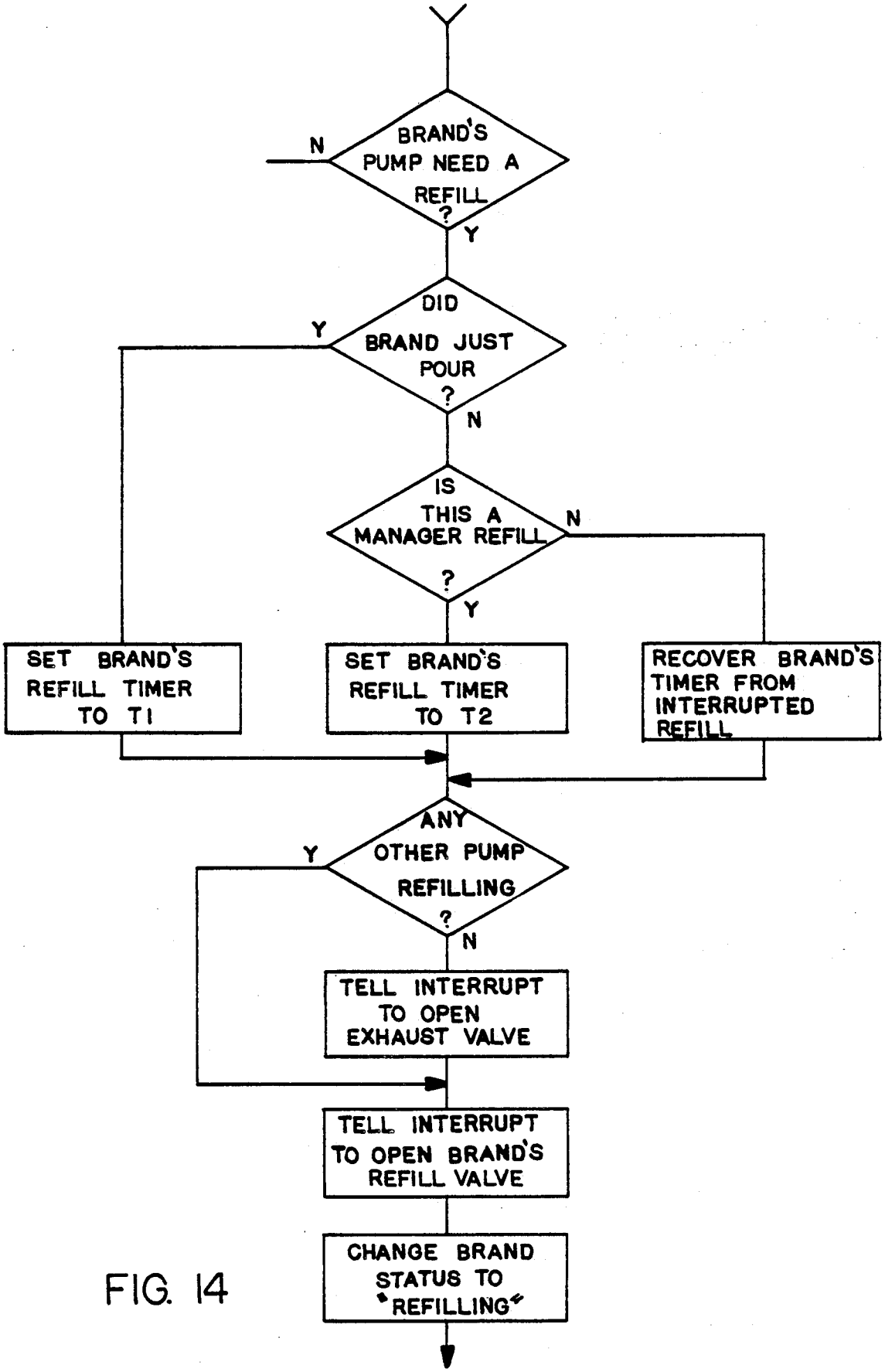
Figure 15:
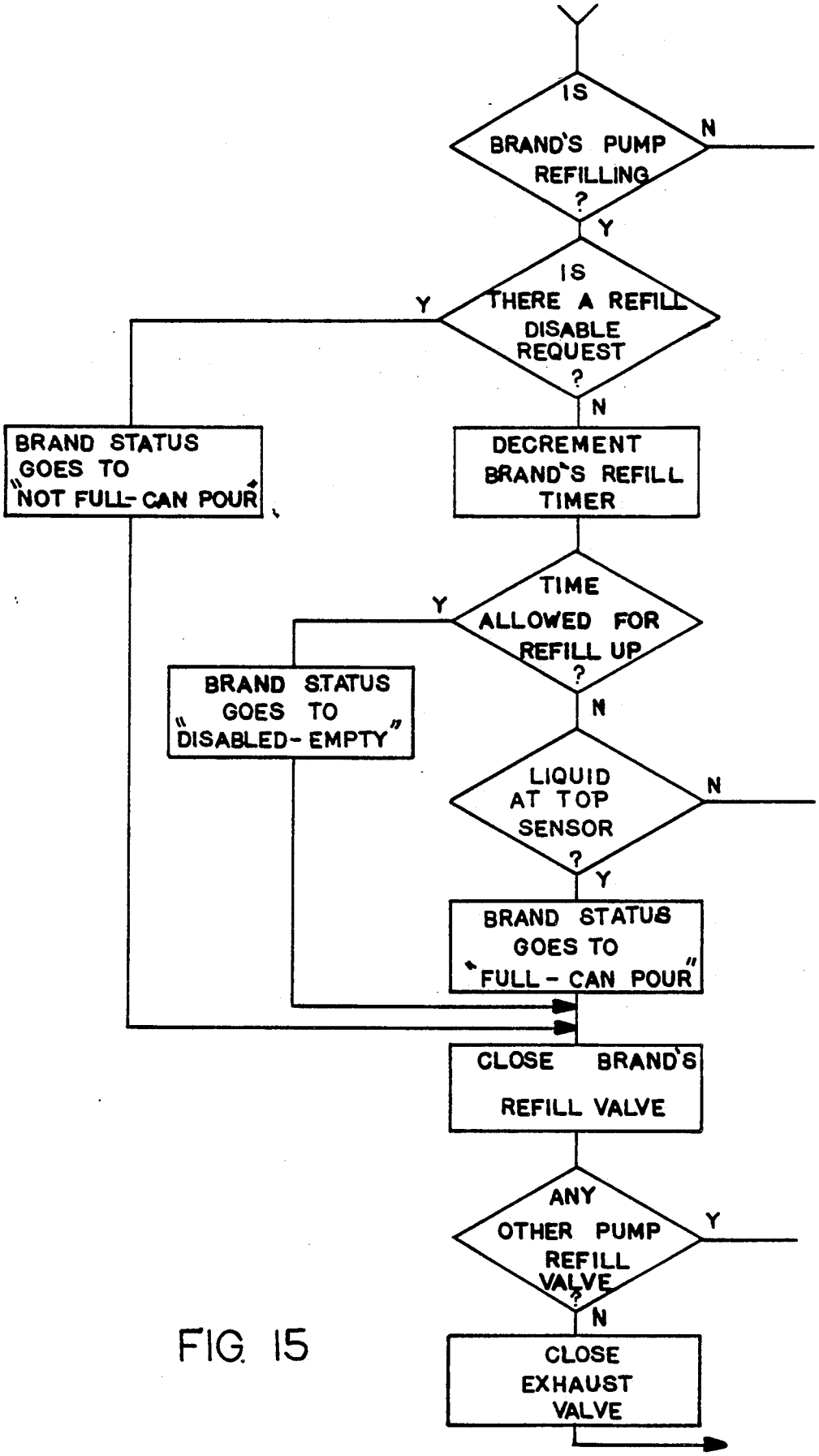

The refilling function is shown in FIG. 14 as an expansion of the "Handle Designated Brand" function of FIG. 8 and is shown in FIG. 15 as an expansion of the final block of the Interrupt subroutine of FIG. 9. With reference now to FIG. 14, it will be seen that the microprocessor determines whether the brand's pump needs refilling. If so, a determination is made whether or not the brand just finished a dispensing cycle. If it did, the refill timer is set to T1 to begin the refilling of that brand. If the brand did not just pour, than a determination is made as to whether the manager has requested a refill from the keyboard. If the manager has made such a request, the refill timer is set to T2. If the manager did not request a refill, such is an indication that the brand was in a refill cycle and was interrupted for a dispensing cycle. In such case, the microprocessor recovers the time remaining for the interrupted refill cycle. The microprocessor then determines whether any other pumps are refilling and, if not, the Interrupt subroutine opens the exhaust valve such that the pump may be replenished. If other pumps are refilling at that time, the exhaust is already open and the step is omitted. The Interrupt subroutine then opens the brand's refill valve and that brand's status is changed to "refilling".

As shown in FIG. 15, the brand's status is refilling, a determination is made as to whether or not a refill disable request has been made. If so, the brand's status is changed to "not full can pour," indicating that, while the pump is not full, there is still syrup available for dispensing. If there is no disable request, the refill timer is decremented, or allowed to time down. If the time allowed for refilling is up before the pump is refilled, the brand's status is changed to "disabled-empty," indicating a problem exists either at the pump or with a lack of syrup in that the pump was not refilled within the time alloted. In normal operation, the liquid will reach the top sensor of the pump before the clock has timed out, indicating that the pump is available for dispensing syrup and setting the brand status to "full-can pour." Whether the brand's status indicates that the pump is empty but a pour can be made, or whether it indicates that the pump did not fill in the required time or whether it indicates that the pump is full and dispensing can be made, the brand's refill valve is closed and, if no other pumps are refilling, the exhaust valve is similarly closed, completing the refill cycle. Obviously, if other pumps are refilling, the exhaust valve remains open until the refilling cycle of the final pump is concluded.

It will be appreciated by those skilled in the art that numerous and various modifications may be made to the algorithm of the system to provide for desired features. The foregoing description has been of a general nature to present to those skilled in the art a means for achieving certain of the features of the invention, but the concept of the invention is not limited to such embodiments.

Thus it can be seen that the objects of the invention have been satisfied by the techniques and apparatus presented hereinabove. While in accordance with the patent statutes only the best mode and preferred embodiment of the invention has been presented and described in detail, it is to be understood that the invention is not limited thereto or thereby. Accordingly, for an appreciation of the true scope and breadth of the invention reference should be had to the following claims.

What is claimed is:

1. A beverage dispenser, comprising:

a pour head;

first means for dispensing a soda through said pour head;

second means for dispensing a flavoring syrup through said pour head;

control means interconnected between said first and second means for regulating timed periods of dispensing said soda and flavoring syrup through said pour head during a dispensing cycle to obtain a desired drink; and wherein said pour head comprises a plurality of soda-dispensing passages arranged in a geometric pattern encompassed by a plurality of syrup-dispensing passages, at least certain of said syrup-dispensing passages extending at an angle through said pour head with respect to said soda-dispensing passages, such that projected extensions of said certain syrup-dispensing passages do not intersect with a center of said geometric pattern and syrup from said certain syrup-dispensing passages tracks along side of a flow of soda from said soda-dispensing passages in spaced relationship therefrom, said flow of syrup convoluting said flow of soda.

2. The beverage dispenser according to claim 1 wherein said soda-dispensing passages are substantially tangential to each other at a surface of said pour head where said soda-dispensing passages exit.

3. The beverage dispenser according to claim 1 wherein said soda-dispensing passages are conical as they pass through said pour head and are of increasing diameter in a direction of soda flow therethrough.

4. A beverage dispenser, comprising:

a source of soda;

a source of syrup;

a pour head in communication with said sources of syrup and soda;

first means for dispensing soda from said sources of soda and through said pour head;

second means for dispensing flavoring syrup from said source of syrup and through said pour head;

control means interconnected between said first and second means for regulating timed periods of dispensing said soda and flavoring syrup through said pour head during a dispensing cycle to obtain a desired drink; and wherein said pour head comprises a block having a plurality of soda-dispensing passages encompassed by a plurality of syrup-dispensing passages passing therethrough, a cover plate having passages therethrough, the passages through said block and cover plate being in corresponding spaced relationship to each other, said cover plate being attached to said block with the passages of the cover plate and block being in misalignment with each other.

5. The beverage dispenser according to claim 4, wherein said soda-dispensing passages are substantially tangential to each other at a surface of said pour head where said soda-dispensing passages exit.

6. The beverage dispenser according to claim 4 wherein flexible tubes pass through said passages in said cover plate and ends of said tubes are received within said passages within said block, said tubes being crimped and held by said misalignment.

7. The beverage dispenser according to claim 4 wherein said pour head further includes a water dispensing passage in communication with said control means for dispensing water with said soda to reduce the carbonation level of the desired drink.

8. The beverage dispenser according to claim 4 wherein said soda-dispensing passages are conical as they pass through said pour head and are of increasing diameter in a direction of soda flow therethrough.

9. The beverage dispenser according to claim 8 wherein at least certain of said syrup-dispensing passages extend at an angle through said pour head with respect to said soda-dispensing passages.

10. A beverage dispenser for dispensing beverage into a receiving container, comprising:

a source of syrup;

a source of soda; and a pour head in communication with said syrup and soda sources for dispensing syrup and soda in spaced-apart streams, precluding appreciable mixing of said syrup and soda until received by said container, said pour head comprising a cluster of orifices connected to said source of soda, and orifices peripheral to said cluster connected to said source of syrup.

11. The beverage dispenser according to claim 10 wherein said orifices within said cluster are in close tangential relationship to each other.

12. The beverage dispenser according to claim 10 wherein said orifices within said cluster are of a conical shape, being of increasing diameter in the direction of soda flow.

13. The beverage dispenser according to claim 10 wherein said pour head defines said stream of soda as a truncated cone, which is convoluted by said stream of syrup.

14. The beverage dispenser according to claim 13 wherein certain of said peripheral orifices angle inwardly toward said cluster, but offcenter from said cluster.

15. The beverage dispenser according to claim 10 wherein said orifices communicate with said sources of syrup and soda through flexible tubes crimped at said pour head and thereby held in fixed communication with said orifices.

16. The beverage dispenser according to claim 15 wherein said tubes communicating with said source of syrup are elastic, contracting upon termination of syrup dispensing to withdraw syrup from an end of said orifice.

17. The beverage dispenser according to claim 10 wherein said orifices communicate with said source of soda through tubes which bend at said pour head in proximity to said orifices.

18. The beverage dispenser according to claim 17 wherein each said tube increases in diameter in proximity to said bend.

19. The beverage dispenser according to claim 18 wherein said tube is defined by a first tubular member receiving a second tubular member where said tube increases in diameter, said second tubular member having an end thereof cut on a bias, said end being received within said first tubular member.

* * * * *